United States Patent [19]

Thettu

[11] B 3,988,817

[45] Nov. 2, 1976

[54] PRESSURE ROLL FOR DRY FUSER APPARATUS

[75] Inventor: Raghulinga R. Thettu, Webster, N.Y.

[73] Assignee: Xerox Corporation, Stamford, Conn.

[22] Filed: Dec. 18, 1973

[21] Appl. No.: 425,770

[44] Published under the Trial Voluntary Protest Program on Jan. 28, 1975 as document No. B 425,770.

[52] U.S. Cl. ..... 29/130; 29/132

[51] Int. Cl. ..... B21b 31/08

[58] Field of Search ..... 29/132, 130

[56] References Cited

UNITED STATES PATENTS

| | | | |
|---|---|---|---|
| 1,883,187 | 10/1932 | Weber | 29/130 X |
| 2,592,134 | 7/1971 | Paterson | 29/130 X |
| 3,152,387 | 10/1964 | Macleod | 29/130 |
| 3,447,600 | 6/1969 | Greene | 29/130 X |
| 3,452,181 | 6/1969 | Stryjewski | 219/216 |
| 3,731,358 | 5/1973 | Artl | 29/132 |
| 3,795,033 | 3/1974 | Donnelly et al. | 29/132 |

FOREIGN PATENTS OR APPLICATIONS

| | | | |
|---|---|---|---|
| 2,306,440 | 8/1973 | Germany. | |
| 18,797 | 1907 | United Kingdom | 29/130 |
| 233,523 | 5/1925 | United Kingdom | 29/130 |

*Primary Examiner*—Alfred R. Guest

[57] ABSTRACT

An improved pressure roll construction for a heated pressure roll fusing apparatus. The pressure roll has an elastomeric core member made of silicone rubber covered by a rigid, flexible sleeve which can be made of metal or fluoroethylene-propylene. The sleeve is covered with an exterior coating made of silicone rubber to enhance paper handling characteristics in the fuser nip.

5 Claims, 3 Drawing Figures

PRESSURE ROLL FOR DRY FUSER APPARATUS

This invention relates to an improved pressure roll for a dry fusing apparatus for use in an electrostatic reproduction system to produce high quality copies free of toner offset and contaminants.

It has been recognized that one of the preferred ways for fusing a powder image to a substrate is to bring the powder into direct contact with a hot surface, such as a heated roller. The roller surface may be dry, i.e., no application of a liquid release agent to the surface of that roller as described for example, in U.S. Pat. Nos. 3,498,596, 3,539,161 and 3,666,247. Alternatively, the fuser roll surface may be wetted with a release agent such as silicone oil as described in U.S. Pat. Nos. 3,268,351 and 3,256,002.

In the dry fusing system there is a tendancy for the fuser roll to collect paper contamination and non-visual or minute toner particles which in turn cause a visual toner offset to build up on the fuser roll surface and be deposited in the copy sheets. This problem is further complicated in a duplex copier system where two-sided copies are passed through the fuser system. In this case the back-up or pressure roll frequently squashes the fused image causing degradation of copy quality.

The present invention is an improved pressure or back-up roll defining the fusing nip with the heated fuser roll to improve paper handling characteristics of the fusing nip and a decrease of paper contaminants and toner offset onto the fusing rolls.

It is therefore the principle object of the present invention to improve heated pressure fusing roll devices.

It is a further object of the present invention to enable removal of paper contaminants and toner offset particles from fusing rolls.

It is a further object of the present invention to prevent toner offset from the surface of the fusing rolls onto copy sheets.

It is a further object of the present invention to improve paper handling characteristics by dry pressure heated fuser systems.

It is a further object of the present invention to prevent squashing and copy quality degradation of duplex copy sheets on the second pass through the pressure heated fusing rolls.

It is a further object of the invention to enable higher pressure loads at the fusing nip without increasing the durometer of core materials.

These and other objects of the invention and further features thereof will be better understood upon reference to the following detailed description of the invention to be read in connection with the drawings wherein.

Figure 1:
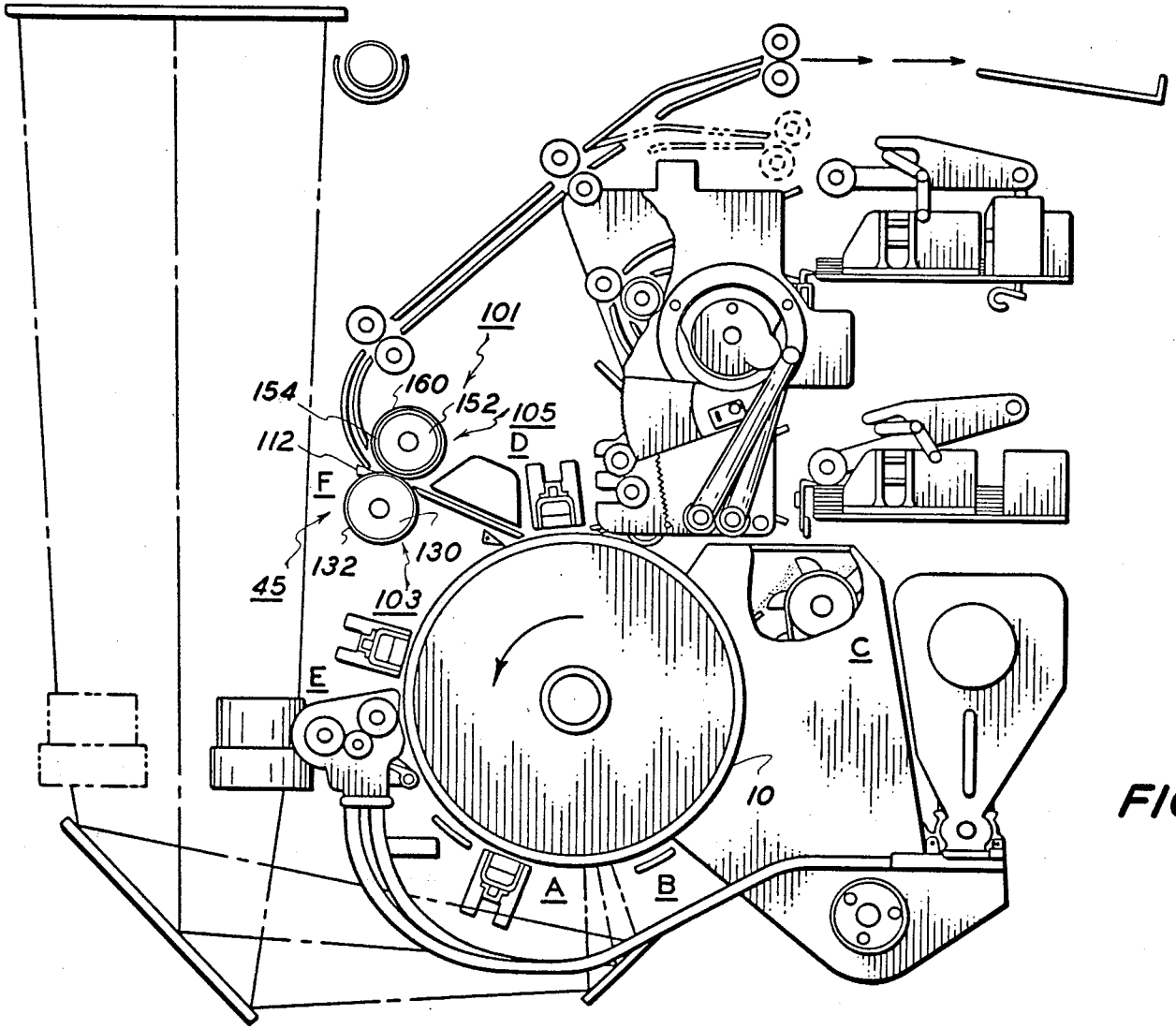
FIG. 1 illustrates schematically a xerographic reproducing apparatus incorporating a heated pressure fuser roll apparatus constructed in accordance with the present invention.

Referring now to the drawings, there is shown in FIG. 1 a preferred embodiment of the subject invention in a suitable environment such as an automatic duplex xerographic reproducing machine producing two-sided copies. The automatic xerographic reproducing machine includes a xerographic plate or surface 10 formed in the shape of a drum. The plate has a photoconductive layer or light receiving surface on a conductive backing, journaled in a frame to rotate in the direction indicated by the arrow. The rotation will cause the plate surface to sequentially pass a series of xerographic processing stations. For the purpose of the present disclosure the several xerographic processing stations in the path of movement of the plate surface may be described functionally as follows:

A charging station A, at which a uniform electrostatic charge is deposited on the photoconductive plate;

An exposure station B, at which light or a radiation pattern of copies to be reproduced is projected onto the plate surface to dissipate the charge in the exposed areas thereof to thereby form a latent electrostatic image of the copy to be reproduced;

A developing station C, at which xerographic developing material, including toner particles having an electrostatic charge opposite that of the latent electrostatic image, is cascaded over the latent electrostatic image to form a toner powder image in configuration of the copy being reproduced;

A transfer station D at which the toner powder image is electrostatically transferred from the plate surface to a transfer material or a support surface; and A drum cleaning and discharge station E at which the plate surface is brushed to remove residual toner particles remaining thereon after image transfer and at which the plate is exposed to a relatively bright light source to effect substantially complete discharge of any residual electrostatic charge remaining thereon.

It will be appreciated that for duplex copying that the copy sheets are passed through the fuser rolls once for each side or a total of two times.

The description of the xerographic processing stations is sufficient for a proper understanding of the instant invention. Further details may be had by reference to U.S. Pat. No. 3,578,859 filed July 3, 1969 and commonly assigned herewith.

At the fusing station F the fusing assembly 101 comprises a fuser roll 103 and pressure roll 105 through which the copy sheet to be fused is advanced through the nip formed by contact of the fuser roll and pressure roll. The copy sheet is stripped from the fuser roll 103 by stripper fingers 112. The fuser roll comprises a rotating member 130 having an elastic compressible coating 132 made of silicone rubber or any suitable heat resistant compressible material as described for example in the aforementioned patents. The rotating member may be internally heated by a heat source as described in U.S. Pat. No. 3,666,247 or externally heated as described in U.S. Pat. Nos. 3,498,586 and 3,539,161. The pressure roll has an improved construction which improves the paper handling characteristics of the fusing apparatus particularly in the case of two-sided copy sheets as will be explained more fully hereinafter.

Figure 2:
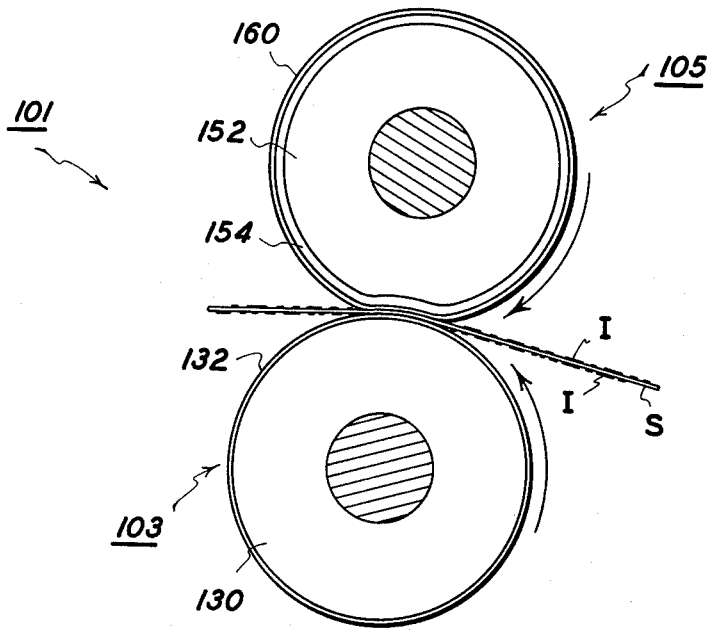
FIG. 2 is a side view of the fusing nip during duplex operation illustrating details of the invention.
Figure 3:
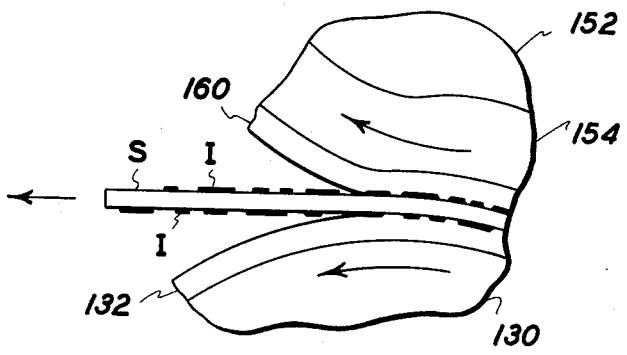
FIG. 3 is a partial view similar to FIG. 2 illustrating the sharp exit radius between the pressure roll and fuser roll.

Referring now specifically to FIGS. 2 and 3, which illustrate duplex copying operation, pressure roll 105 comprises an elastomeric core 152 made of silicone rubber having a slightly higher durometer than coating 132 of the fuser roll. Core member 152 is covered by a rigid, flexible sleeve 154. Sleeve 154 can be made of any suitable materials such as, metal or fluoro-ethylene-propylene manufactured under the trademark of Teflon by duPont Corporation. A preferred metal is a tempered steel.

In accordance with the present invention a thin coating 160 of elastomeric material covers sleeve 154. Desirably the coating is made of silicone rubber of the same or lower in durometer than the coating 132 of the fuser roll. Sleeve 154 preferably has a thickness ranging from about 2 mils to about 22 mils. In the case of a metal sleeve the thickness is about 2 to 4 mils and in the case of a Teflon sleeve the thickness is about 10 to about 22 mils. Coating 160 has a thickness ranging from about 5 mils to about 30 mils, and preferably is about 10 mils. By this structure improved paper handling is experienced particularly at the exit of the fusing nip as best shown in FIG. 3. As understood the reasons for improved characteristics are believed to reside in the high strain at the nip exit which is transmitted back to a microscopic level on the back of the copy sheet S bearing images I. Macro deformation together with micro-conformability acts on the back of the copy sheet as an enormous micro suction cup effect. There is a high friction between the pressure roll and copy sheet S. Since the elastomer coating 160 is an insulator it also resists heat transfer from the fuser roll to the pressure roll and therefore maintains the pressure roll cooler which reduces toner offset. Additionally, there is a sharp radius profile at the exit of the nip enhancing the quality of the fix. It will be appreciated that the pressure roll construction of the invention enables higher pressure loads to be obtained without increasing the durometer of core materials.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. In a dry heated pressure fusing system for fusing toner images of an electrostatic copying machine in which a heated dry fuser roll having elastomeric coating and an elastomeric pressure roll define a contact arc to fuse toner images onto copy sheets, an improved pressure roll positioned to contact the dry heated fuser roll surface comprising a core member made of silicone rubber, said core member being covered with a rigid sleeve member, said sleeve member being coated with a thin layer of elastomeric material of the same or lower durometer as said core member, wherein said rigid sleeve has a thickness ranging from about 2 to about 4 mils.

2. Apparatus according to claim 1 wherein said elastomeric coating has a thickness ranging from about 5 to about 30 mils.

3. Apparatus according to claim 2 wherein said elastomeric coating is made from silicone rubber.

4. Apparatus according to claim 3 wherein said sleeve is made from tempered steel.

5. In a dry heated pressure fusing system for fusing toner images of an electrostatic copying machine in which a heated dry fuser roll having elastomeric coating and elastomeric pressure roll define a contact arc to fuse toner images onto copy sheets, an improved pressure roll positioned to contact the dry heated fuser roll surface comprising a core member made of silicone rubber, said core member being covered with a rigid, sleeve member, said sleeve member being coated with a thin layer of elastomeric material of the same or lower durometer as said core member, wherein said rigid sleeve has a thickness ranging from about 10 to about 22 mils, wherein said sleeve is made from fluoro-ethylene propylene.

* * * * *